US005626365A

United States Patent [19]

Petteway

[11] Patent Number: 5,626,365

[45] Date of Patent: May 6, 1997

[54] TWO-WAY BOOK

[76] Inventor: Becky A. Petteway, 1654 S. Raford, Springfield, Mo. 65809

[21] Appl. No.: 448,800

[22] Filed: May 24, 1995

[51] Int. Cl.[6] ..... B42D 1/00

[52] U.S. Cl. ..... 281/15.1; 281/38; 281/51

[58] Field of Search ..... 281/15.1, 21.1, 281/38, 51; 462/79; 434/156, 159, 167, 174, 176, 178

[56] References Cited

U.S. PATENT DOCUMENTS

| | | | |
|---|---|---|---|
| 1,353,371 | 9/1920 | Winslow . | |
| 2,544,568 | 3/1951 | Shepherd . | |
| 2,917,325 | 12/1959 | Sines . | |
| 3,028,178 | 4/1962 | Pietrangeli et al. . | |
| 3,738,686 | 6/1973 | Morse . | |
| 4,487,590 | 12/1984 | Becker et al. . | |
| 4,606,554 | 8/1986 | Lederman | 281/51 X |
| 5,033,964 | 7/1991 | Phelps . | |

OTHER PUBLICATIONS

Kansas City Star Newspaper, Apr. 3, 1996 p. 6, "School Notes".

*Primary Examiner*—Willmon Fridie, Jr.

*Attorney, Agent, or Firm*—Chase & Yakimo

[57] ABSTRACT

A two-way book especially useful when reading to a group of young children. The book includes a binding and a plurality of pairs of pages which are movably attached to the binding. Each pair of pages has a first page and a second page with corresponding indicia thereon. Each pair of pages is also movable between an open position and a viewing position. In the open position, the first and second pages of at least one pair are substantially adjacent one another with the binding extending therebetween. In the demonstrating position, the first and second pages of one pair face opposite one another with the remaining pairs of book pages therebetween. Furthermore, the second page faces the reader of the book and the first page faces the listener of the reader so that the listener can observe the indicia as the reader reads the book. Preferably, the indicia on each page of a pair of pages is identical and includes both a text and an illustration. An alternative embodiment provides for indicia on side by side pages to be simultaneously displayed and read by the listener and reader.

6 Claims, 2 Drawing Sheets

TWO-WAY BOOK

FIELD OF THE INVENTION

This invention relates to a two-way book which is especially useful when reading aloud to young children. More specifically, the book has a specially designed page format which allows children, typically seated facing the reader, to not only listen to the story being read from the book by the reader, but to simultaneously read along and view the corresponding illustration.

BACKGROUND OF THE INVENTION

Child care providers and elementary teachers are typically unable to read to the children under their care or in their class on a one on one basis. When reading to a group of young children, the children typically sit opposite and facing the reader. The reader must read the text of each page and then turn the book to face the children so that they can see the illustrations. This procedure is obviously very awkward. Furthermore, the children cannot follow the text as it is read or view the illustrations as it is read, which would both enhance their reading skills as well as their attentiveness.

SUMMARY OF THE INVENTION

Accordingly, a primary object of the subject invention is to provide a two-way book having a plurality of pairs of pages with identical textual and illustrative material thereon.

A further object of the subject invention is to provide a two-way book that allows children to follow the text and view the illustrations as the text is read.

Still a further object of the subject invention is to provide a two-way book for young children which enhances their reading skills.

Yet a further object of the subject invention is to provide a two-way book for young children which increases their attentiveness.

These objects are attained by providing a two-way book comprising a binding and a plurality of pairs of pages. The pairs of pages are rotatively attached to the binding and each pair includes a first page and a corresponding second page. Each first page has an illustration and text thereon which corresponds to an identical illustration and text on the corresponding second page. Each pair of pages is movable to a viewing position wherein the first page and the corresponding second page of a pair face opposite one another with the first page facing a listener, the corresponding second page facing the reader of the book and the other pairs of pages therebetween. An alternative embodiment presents side by side pages facing the listener and reader with corresponding indicia on the opposed sides of the pages. This allows the listener to observe the illustration and read the text simultaneously with the reader of the book.

DETAILED DESCRIPTION

A two-way book 10, as in FIGS. 1–4, allows a group of young children not only to listen to the story being read from the book by a narrator, but to simultaneously read along and view the corresponding illustration. Like any book, two-way book 10 includes a plurality of sheets 12 which present pages of the book in a predetermined sequence so as to tell a story. Sheets 12 are preferably composed of paper material. Alternatively, they could be composed of a cloth or plastic material. Furthermore, like other books, sheets 12 are stacked or aligned with one another and bound by binding 14.

Each sheet 12 forms two pages. The top or front surface of each sheet 12 forms one page and the bottom or rear surface forms the other page thereof. Sheets 12 are movable rotatively about binding 14 between a closed or stacked position, as in FIG. 1, an open position, as in FIG. 2, and a viewing position, as in FIGS. 3 and 4.

In the closed position, sheets 12 are aligned so that the bottom or rear surface of each preceding sheet 12 engages, rests upon and is contiguous with the top or front surface of the next sequential or subsequent sheet 12, except the bottom surface of the last sheet 12 in the sequence which rests against a back cover page of book 10. Accordingly, the top surface of each sheet 12 engages and rests beneath the bottom or rear surface of the previous sheet 12 in the sequence, except the top surface of the first sheet 12 which engages a front cover page of book 10.

Figure 2:
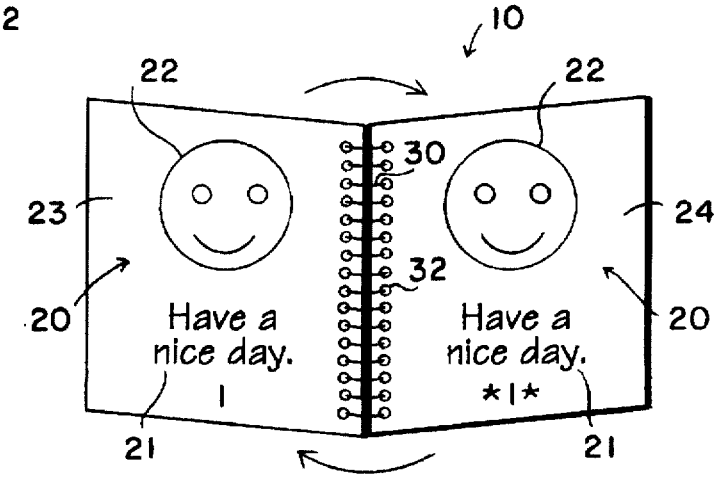
FIG. 2 is the two-way book of FIG. 1 in its opened position and showing one pair of pages having identical indicia thereon.

The bottom and top surfaces in engagement with each other form pairs of first and second corresponding pages 23 and 24, as seen in FIG. 2. Specifically, each bottom surface forms a first page 23 of a page pair, and the top surface of the next sequential sheet 12 forms the corresponding second page 24 of the page pair. Each pair's first page 23 and second page 24 have preferably identical indicia 20 thereon, which preferably includes text 21 from which the reader reads and illustrative material 22 corresponding to the text. (It is understood that additional text may be on the reader's pages e.g. comments, teaching aides, etc. which need not be available for viewer display.) Alternatively, indicia 20 may include only text on the second pages 24 from which the reader reads and a corresponding illustration on the first pages 23 for viewing by the listeners as the text is read.

Figure 1:
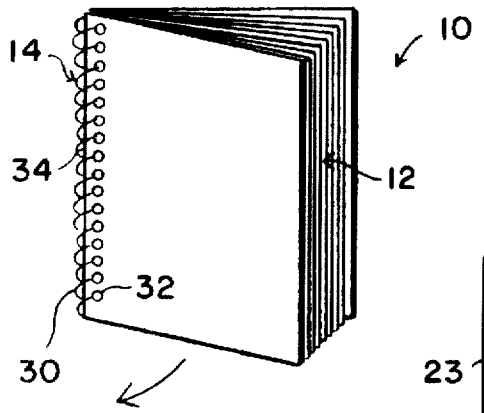
FIG. 1 is a front view of a two-way book substantially in its closed position in accordance with the present invention.

Two-way book 10 is opened from its stacked or closed position as in FIG. 1 into its open position as in FIG. 2 by rotating pages 23 and 24 around binding as shown by the arrow of FIG. 1. In the open position, one pair of first and second pages 23 and 24 faces the reader, which is similar to any typical book. However, as previously discussed, identical indicia 20 is preferably printed on both of facing pages 23 and 24.

Figure 3:
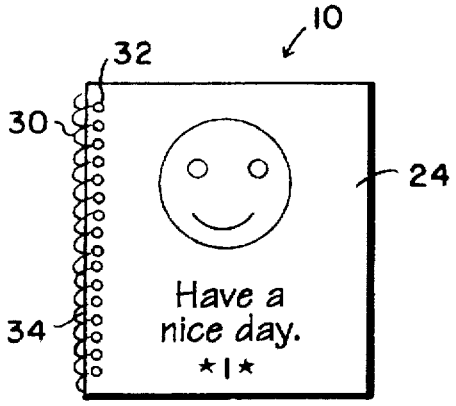
FIG. 3 is the two-way book of FIG. 1 in its viewing position, showing the second page of one pair of pages as seen by the reader.
Figure 4:
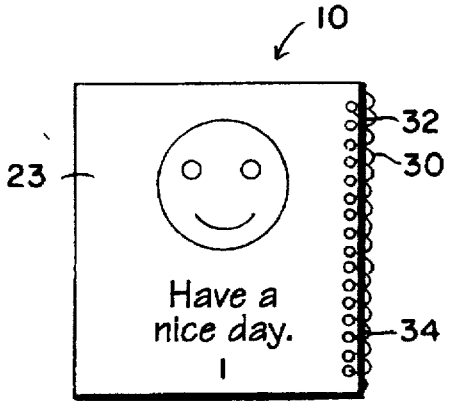
FIG. 4 is a rear view of the two-way book of FIG. 1, showing the first page of one pair of pages as seen by the listeners.

Two-way book 10 can be moved into its viewing position by further rotation of page 23, as in FIGS. 3 and 4, as shown by the arrows of FIG. 2. In this position, a first page 23 of a pair of pages faces the listeners while a second page 24 of the same pair of pages faces the reader. Thus, the listeners can view the illustrative material 22 of indicia 20 and read the text 20 of indicia 20 simultaneously with the reader. This improves the listeners' reading skills since they can follow the text 21 as it is read aloud by the reader, and also increases their attentiveness while listening to the reader since they can simultaneously view the illustration 22 which corresponds to the text 21 as the text 21 is read. The listening children do not have to wait until the reader has completed reading the textual portion of indicia 20 and turned the entire book around for viewing any illustrations.

Binding 14 preferably includes a ring member 30 which extends through spaced apart and aligned holes 32. Holes 32 extend along and through the left side 34 of sheets 12, as in FIG. 1. Binding 14 movably and rotatively couples sheets 12 together along the left side 34 thereof when sheets 12 are in the stacked or closed position, as in FIG. 1. Binding 14 allows free movement of sheets 12 about binding 14 between each position.

When book 10 is in its open position, binding 14 extends between at least the pair of pages 23 and 24 to which book 10 is opened. When book 10 is in its viewing position, binding 14 again extends along the left side 34 of book 10, as seen in FIGS. 3 and 4. Alternatively, binding 14 may take the form of tape or glue adhered along the left side 34 of sheets 12, or may be any other type of commonly used binding.

Figure 5:
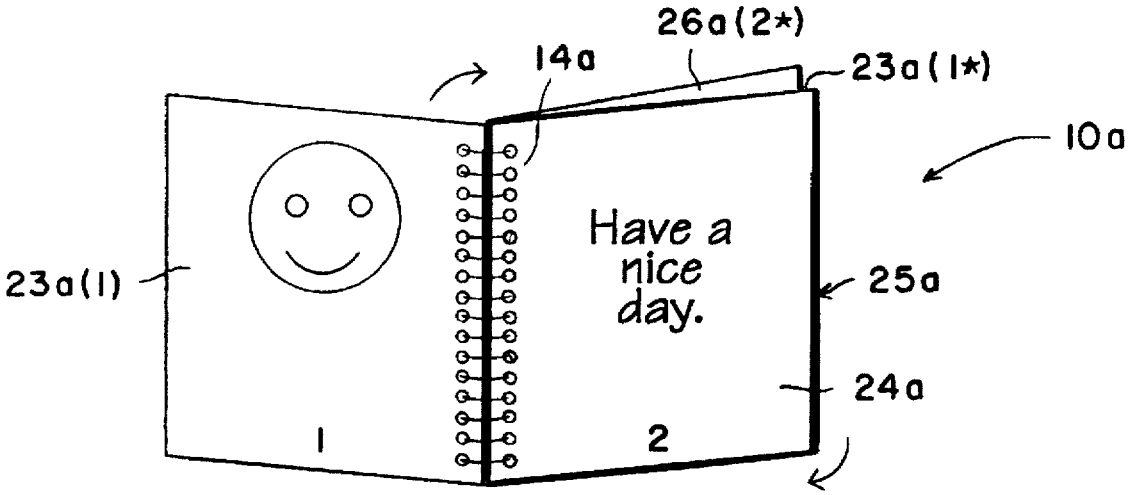
FIG. 5 is a rear view of a second embodiment of a two-way book in accordance with the present invention showing a first pair of pages facing the listeners.
Figure 6:
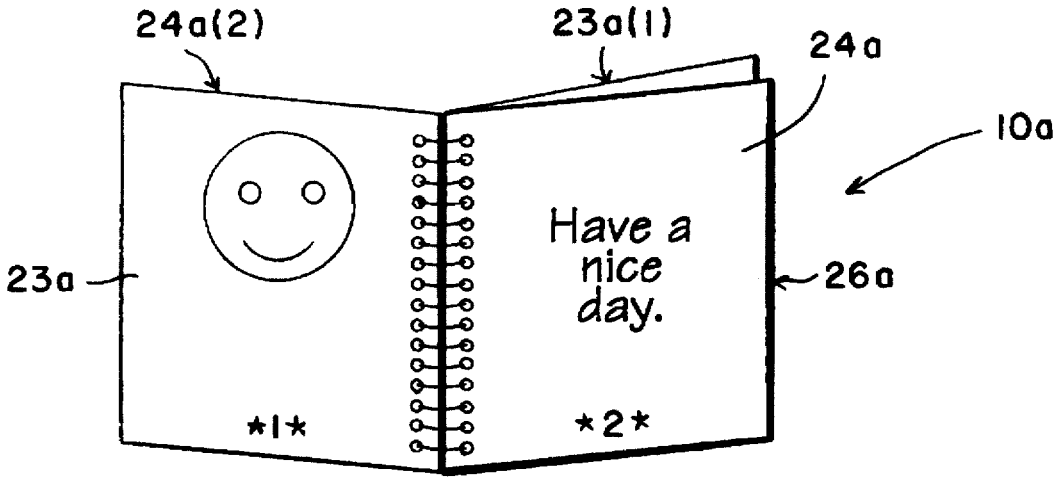
FIG. 6 is a front view of the two-way book of FIG. 5 showing a second pair of pages facing the reader and having indicia thereon identical to the indicia on the first pair of pages of FIG. 5.

Second Embodiment of FIGS. 5 and 6

FIGS. 5 and 6 show a second embodiment of a two-way book 10*a*, and only the differences between the first and second embodiments are discussed herein.

Unlike the first embodiment which has pairs of identical pages, the second embodiment has pairs of identical pairs 25*a* and 26*a* of pages 23*a* and 24*a* which rotate about binding 14*a*. In other words, two pages 23*a* and 24*a* are printed on the bottom and top surfaces of first and second adjacent sheets and form a first pair 25*a*. See FIG. 5. Then, pages 23*a* and 24*a* are duplicated on the bottom surface of the second sheet and a third subsequent sheet, respectively, to form a second pair 26*a*. See FIG. 6. Together, pairs 25*a* and 26*a* form a pair of identical pairs of pages 23*a* and 24*a*. Each first pair 25*a* is printed on the two pages immediately preceding second pair 26*a*. Thus, the first page 23*a* of second pair 26*a* is printed on the front or bottom surface of the same sheet of paper as the second page 24*a* of first pair 25*a*. This particular formation of pages presents a book which allows the listeners to simultaneously view two pages of book 10*a* as they are read by the reader.

It is to be understood that while certain forms of this invention have been illustrated and described, it is not limited thereto except insofar as such limitations are included in the following claims and allowable functional equivalents thereof.

Having thus described the invention, what is claimed as new and desired to be secured by Letters Patent is as follows:

1. A book comprising:

a plurality of sheets having front and rear opposed surfaces;

means for binding said sheets in a stack to position a rear surface of a preceding sheet of said plurality of sheets contiguous to a front surface of a sheet subsequent to said preceding sheet;

a first set of indicia on a rear surface of at least one of said preceding sheets and on a rear surface of at least one said subsequent sheet, said indicia being generally equivalent and in a same spatial relationship relative to said binding means;

a second set of equivalent indicia on a front surface of said subsequent sheet and on a front surface of a sheet proceeding said subsequent sheet and in a same spatial relationship relative to said binding means and said first set of indicia;

said preceding sheet rear surface and said front surface of said subsequent sheet being rotatable about said binding means to a position facing away from a front surface of said sheet proceeding said subsequent sheet and a book user, said positioned preceding subsequent and proceeding sheets simultaneously displaying said first and second sets of equivalent indicia in opposed normal directions relative to said binding means and a book user, whereby to allow a book user to simultaneously display to another and view said first and second sets of indicia in opposed normal directions.

2. A book comprising:

a plurality of sheets having front and rear opposed surfaces relative to a book user;

means for binding said sheets in a stack to position a rear surface of a preceding sheet contiguous to a front surface of a subsequent sheet;

a first set of indicia on a rear surface of at least one of said preceding sheets, said first set of indicia being generally equivalent to indicia on a rear surface of a subsequent second sheet and in a same spatial relationship relative to said binding means;

a second set of indicia on a front surface of said subsequent sheet and being generally equivalent to indicia on a front surface of a subsequent third sheet and in a same spatial relationship relative to said binding means and said first set of indicia;

said preceding sheet being rotatable about said binding means to direct said first set of indicia on said rear surface to a position opposite said second set of indicia on said front surface of said third sheet, with said second sheet being rotatable about said binding means to a position laterally adjacent said first and third sheets, said positioned first and second sheets cooperating with said third sheet to direct said first and second indicia and said indicia equivalent thereto on said respective sheets in first and second opposed normal directions relative to said binding means, whereby to allow said first and second sets of indicia to be viewed by a book user and a person facing a book user.

3. A two-way book, comprising:

a means for binding;

a plurality of first, second and third pages movably attached to said means for binding, each one of said pages having first or second sets of indicia thereon, said first set of indicia on said first page being identical to a first set of indicia on said second page with said second set of indicia on said second page being identical to a second set of indicia on said third page, all of said indicia being in a same spatial relationship relative to said means for binding to form pairs of identical first and second sets of indicia among said first, second and third pages; and each said pair of identical first and second sets of indicia on said first, second and third pages movable to a viewing position by selective rotation of said pages around said means for binding so that said pairs of first and second sets of indicia on said pages face normally opposite one another, with a first pair of said first and second sets of indicia on said facing a listener, a second pair of first and second sets of indicia on said pages facing a reader of said book, whereby the listener observes said first pair of indicia on said pages as the reader reads said identical second pair of indicia.

4. A book as claimed in claim 1, wherein said preceding, proceeding and subsequent sheets are adjacent in said stack of said plurality of sheets.

5. A book as claimed in claim 1, wherein said proceeding sheet becomes said preceding sheet upon a rotation of said proceeding sheet about said binding means to a position facing normally away from a book user.

6. A book comprising:

a plurality of sheets each sheet having front and rear opposed surfaces with indicia thereon for sequentially presenting a story lines, each of said story line sheets skipping over an intervening sheet;

an intervening sheet positioned between said story line sheets, each intervening sheet further comprising:

indicia on the front surface of an intervening sheet equivalent to indicia on a front surface of a subsequent sheet of said story line sheets;

indicia on a rear surface of said intervening sheet equivalent to indicia on a rear surface of a preceding sheet of said story line sheets;

means for binding said story line sheets and said intervening sheets in a stack; and said rear surface of a preceding story line sheet and a front surface of said subsequent intervening sheet being rotatable about said binding means to a position facing away from a book reader, said rotation presenting said rear surface of said intervening sheet and a front surface of a subsequent story line sheet to a reader, whereby to display indicia equivalent to the story line in a first direction away from the reader and a second direction facing the reader.

* * * * *

UNITED STATES PATENT AND TRADEMARK OFFICE

CERTIFICATE OF CORRECTION

PATENT NO. : 5,626,365

DATED : May 6, 1997

INVENTOR(S) : Becky A. Petteway

It is certified that error appears in the above—identified patent and that said Letters Patent is hereby corrected as shown below:

Column 4, line 21, after the word "preceding" insert --first--.

Column 4, line 22, after the word "subsequent" insert --second--.

Column 4, line 33, after the word "preceding" insert --first--.

Column 4, line 38, after the word "and" insert --subsequent--.

Column 4, line 39, after the word "positioned" insert --preceding--.

Column 4, line 65, after the word "said" insert --pages--.

Signed and Sealed this

Fifth Day of August, 1997

Bruce Lehman

*Attest:*

BRUCE LEHMAN

*Attesting Officer*

*Commissioner of Patents and Trademarks*